US006019329A

United States Patent [19]

Edelstein

[11] Patent Number: 6,019,329

[45] Date of Patent: Feb. 1, 2000

[54] CLAMPS

[75] Inventor: David Andrew Edelstein, London, United Kingdom

[73] Assignee: Triple E Ltd., United Kingdom

[21] Appl. No.: 08/961,310

[22] Filed: Oct. 30, 1997

[51] Int. Cl.[7] ..... G09F 7/18

[52] U.S. Cl. ..... 248/228.3; 248/229.12; 248/321

[58] Field of Search ..... 248/228.3, 222.14, 248/229.12, 229.22, 231.41, 321, 222.13, 225.21, 229.24, 229.25, 230.3, 230.6, 231.61, 231.71, 231.81, 230.07, 231.85, 74.2, 55, 74.1

[56] References Cited

U.S. PATENT DOCUMENTS

| | | | |
|---|---|---|---|
| 614,880 | 11/1898 | Miller | 248/29.12 |
| 1,754,929 | 4/1930 | Atticks et al. | 248/230.6 |
| 1,857,293 | 5/1932 | Vroom | 248/55 |
| 4,332,363 | 6/1982 | Ware | 248/321 |
| 4,477,865 | 10/1984 | Tsuyama | 362/396 |
| 4,848,714 | 7/1989 | Ziaylek, Jr. et al. | 248/313 |
| 4,862,336 | 8/1989 | Richardson et al. | 362/285 |
| 5,106,050 | 4/1992 | Vaccaro et al. | 248/674 |
| 5,584,457 | 12/1996 | Fawcett | 248/229.1 |

*Primary Examiner*—Ramon O. Ramirez
*Assistant Examiner*—Anita M. King
*Attorney, Agent, or Firm*—Bachman & LaPointe, P.C.

[57] ABSTRACT

A clamp for use in stage lighting and similar applications comprises a main body portion which is provided with a pair of wheels and an arm mounted on the main body portion provided with a pair of wheels . A locking handle is pivotally mounted on the arm and is arranged to move the arm between a closed position in which the wheels are engageable with a bar or rail and an open position in which the wheels are clear of the bar or rail. A bolt or screw is secured to the arm and is adapted for attachment to the clamp of a lantern.

9 Claims, 1 Drawing Sheet

CLAMPS

FIELD OF THE INVENTION

This invention relates to clamps and is particularly concerned with clamps for use in stage lighting and for similar applications.

BACKGROUND OF THE INVENTION

Lighting used for the illumination of stages and like platforms is commonly suspended from an overhead rail. The lanterns used for such lighting are large and heavy and moving them along a bar in order to adjust their position is difficult with existing clamps.

SUMMARY OF THE INVENTION

The present invention aims to provide a clamp for lighting which can readily be adjusted in its position thereby achieving a considerable improvement over existing clamps.

According to the invention, there is provided a clamp which comprises a main body portion provided with at least one wheel or roller, an arm mounted on the main body portion and also provided with at least one wheel, means for moving the arm between a closed position in which the or each wheel is engageable with a bar or rail and an open position in which the or each wheel is clear of the bar or rail and means for suspending a lantern from the clamp.

Preferably, the main body portion is provided with two wheels or rollers and the arm is likewise provided with two wheels or rollers.

The arm is desirably connected to the main body portion in such a manner that, in the closed position, a hook on the arm is engageable in a recess in the main body portion. A locking means may be provided for locking the arm in the closed position. Said locking means desirably comprise a locking pin which is engageable with the hook on the arm and the recess in the main body portion when the arm is in the closed position.

The means for moving the arm between the closed and open positions desirably comprise a locking handle which is pivotally mounted on the arm.

The clamp may further be provided with means for securing it against movement along the bar or rail. Such means may take the form of a clamping screw which is engageable with the bar or rail in order to immobilise the clamp.

BRIEF DESCRIPTION OF THE DRAWINGS

The invention will now be further described, by way of example, with reference to the drawings, in which.

DESCRIPTION OF PREFERRED EMBODIMENT

Figure 1:
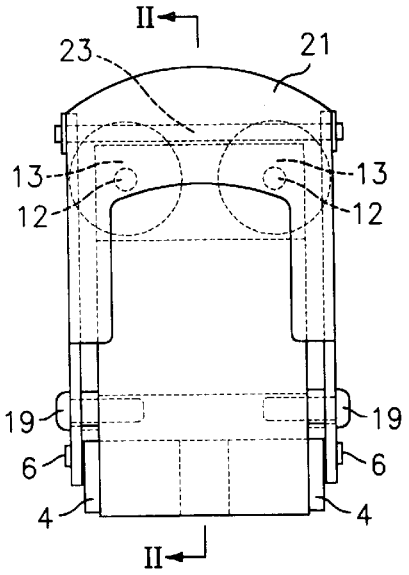
FIG. 1 is a front view of one embodiment of a clamp according to the invention.
Figure 2:
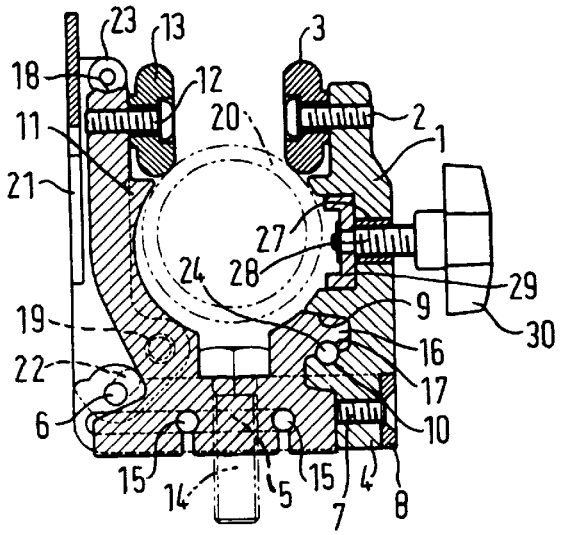
FIG. 2 is a section taken on the line II—II in FIG. 1 in the direction of the arrows and showing the clamp in the closed position of the arm.

Referring to the drawings, a clamp according to the invention comprises a main body portion 1 having a pair of pins 2 on each of which a respective wheel 3 is rotatably mounted. As shown in FIG. 2, the wheels 3 are engageable with a bar or rail 20 and enable the clamp to be readily moved along the bar or rail. A pair of legs 4 are secured by respective screws 7 to the lower end of the main body portion 1 to which a plate 8, serving as a washer is also secured by the screws 7. Each leg is provided with an elongated slot 5 and a pin 6.

An arm 11 is slidably mounted on the legs 4, the arm being formed at each side with a pair of projections 15 engageable respectively in the slots 5 in the respective legs 4. The arm 11 is also provided with a pair of pins 12 on each of which a respective wheel 13 is rotatably mounted said wheels, in the position of the clamp shown in FIG. 2, being located opposite the wheels 3 and likewise engageable with the bar or rail 20. The arm 11 is further provided, in its central lower region, with a bore in which a bolt or screw 14 is located, said bolt or screw serving for the attachment to the clamp of a lantern (not shown).

A locking handle 21 provided with slots 22 is pivotally connected to the arm 11 by pivot pins 19, the slots 22 being engaged over the pins 6 on the legs 4. The handle is pivotally connected to the arm adjacent one end and its other end carries a rotatably mounted roller 23 while the arm 11 is provided at its end remote from the pivotal connection with a concave depression 18 in which the roller 23 is engageable. The roller is preferably made of rubber or like resiliently deformable material for this purpose.

Figure 4:
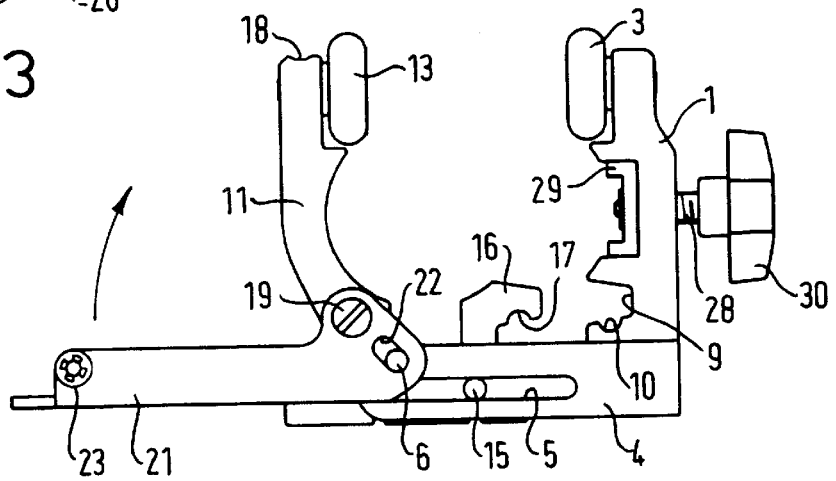
FIG. 4 is a side view of the clamp shown in FIGS. 1 to 3 but showing the clamp with the arm in the open position.

In order to mount the clamp on the bar or rail 20, the clamp must be in the open position of the arm shown in FIG. 4 of the drawings. The clamp can be positioned on the bar or rail so that the wheels 3 are engaged with the bar or rail. At this stage, the locking handle 21 is substantially horizontal as shown in FIG. 4 of the drawings. The locking handle is now pivoted upwardly in the direction of the curved arrow in FIG. 4. By virtue of the engagement of the pins 6 in the slots 22 and the projections 15 in the slots 5, the arm 11 is forced to slide along the legs 4 towards the main body portion 1 of the clamp until a hook 16 on the arm engages in a correspondingly shaped recess 9 in the main body portion 1. At the same time, the roller 23 at the end of the locking handle 21 engages in the concave depression 18 at the end of the arm to hold the arm in the closed position as shown in FIG. 2 of the drawings.

For greater security however, the recess 9 in the main body portion 1 is provided with a semi-circular depression 10 and the hook 16 on the arm 11 is provided with a semi-circular depression 17, the two depressions forming a circular bore when the hook 16 is located in the recess 9. A locking pin 24 can then be inserted in this bore to secure the hook 16 and hence the arm 11 against movement relative to the main body portion 1.

It will thus be seen that the clamp is free to run along the bar or rail 20 by means of the wheels 3 and 13 and thus can be moved to any desired position on the bar or rail. In order to maintain the clamp in this position, a clamping screw 28 is provided, said screw being engageable in a screw-threaded bore 27 in the main body portion 1 and carrying at its inner end a clamping jaw 29 which is engageable with the bar or rail 20 when the clamping screw 28 is screwed into the main body portion by means of a turning handle 30 provided on the outer end of the clamping screw.

Figure 3:
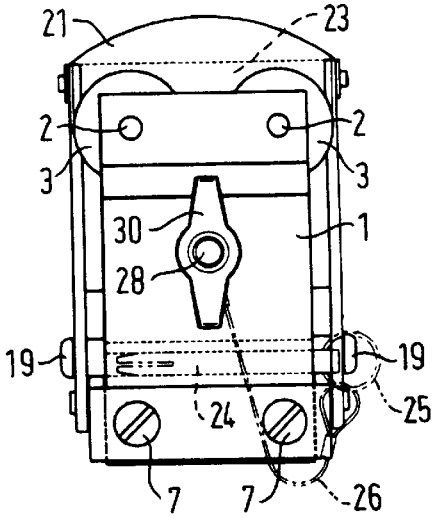
FIG. 3 is a rear view of the clamp shown in FIGS. 1 and 2.

In order to prevent the locking pin 24 from being lost, it is desirably provided with a ring 25 which is connected by a chain 26 to the clamping screw 28 as shown in FIG. 3 of the drawings.

It will be seen that the clamp according to the invention enables the position of a lantern to be readily adjusted on a bar or rail and for the lantern to be readily secured at a desired position on the bar or rail. It is also possible to change a lantern while the clamp is still supported on the bar or rail. The provision of two projections 15 at each side of the arm 11 which are engageable in the slots 5 in the legs 4 ensures that the arm 11 moves with only a sliding movement and that no pivotal movement with respect to the main body portion can take place. The invention is not restricted to the above-described embodiment but variations and modifications may be made without departing from the scope of the invention.

I claim:

1. A clamp comprising a main body portion provided with a first rolling means, an arm mounted on the main body portion and provided with a second rolling means, means for moving the arm between a closed position in which said second rolling means is engageable with a rail and an open position in which said second rolling means is clear of the rail and means for suspending a lantern from the clamp, wherein the arm is provided with a hook and the main body portion is provided with a recess, said hook being engageable in said recess when the arm is in the closed position.

2. A clamp as claimed in claim 1, in which said first rolling means on the main body portion comprises two wheels.

3. A clamp as claimed in claim 1, in which said second rolling means on the arm comprises two wheels.

4. A clamp as claimed in claim 1, in which locking means are provided for locking the arm in the closed position, said locking means comprising a locking pin which is engageable with the hook on the arm and the recess in the main body portion when the arm is in the closed position.

5. A clamp as claimed in claim 1, in which the main body portion is provided with a leg containing slots and the arm is provided with projections, said projections being engageable in the slots in the leg whereby said arm is slidably mounted on the leg.

6. A clamp comprising a main body portion provided with a first rolling means, an arm mounted on the main body portion and provided with a second rolling means, means for moving the arm between a closed position in which said second rolling means is engageable with a rail and an open position in which said second rolling means is clear of the rail and means for suspending a lantern from the clamp, wherein the means for moving the arm between the closed and open positions comprise a locking handle which is pivotally mounted on the arm.

7. A clamp as claimed in claim 6, in which the locking handle is provided with engagement means which are engageable with the arm to hold the arm in the closed position, said engagement means comprising a roller on the locking handle which is engageable in a recess in the arm.

8. A clamp comprising a main body portion provided with a first rolling means, an arm mounted on the main body portion and provided with a second rolling means, means for moving the arm between a closed position in which said second rolling means is engageable with a rail and an open position in which said second rolling means is clear of the rail and means for suspending a lantern from the clamp, wherein means are provided for securing the clamp against movement along the rail, said clamp securing means comprising a clamping screw which is engageable with the rail in order to immobilize the clamp.

9. A clamp as claimed in claim 8, in which the clamping screw is provided with a clamping jaw which is engageable with the rail.

* * * * *